US006900159B2

(12) United States Patent
Yamamoto et al.

(10) Patent No.: US 6,900,159 B2
(45) Date of Patent: May 31, 2005

(54) RECORDING MATERIAL

(75) Inventors: Hiroshi Yamamoto, Shizuoka-ken (JP); Yasuhiro Ogata, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 131 days.

(21) Appl. No.: 10/396,834

(22) Filed: Mar. 26, 2003

(65) Prior Publication Data

US 2003/0186811 A1 Oct. 2, 2003

(30) Foreign Application Priority Data

Mar. 29, 2002 (JP) ..... 2002-096242

(51) Int. Cl.[7] ..... B41M 5/40
(52) U.S. Cl. ..... 503/226; 427/152; 503/200
(58) Field of Search ..... 427/152; 503/200, 503/226

(56) References Cited

U.S. PATENT DOCUMENTS 6,660,689 B2 * 12/2003 Serizawa et al. ..... 503/226

FOREIGN PATENT DOCUMENTS

| | | |
|---|---|---|
| JP | A 11-5366 | 1/1999 |
| JP | A 2000-177244 | 6/2000 |
| JP | A 2002-86917 | 3/2002 |
| JP | A 2003-1940 | 1/2003 |

* cited by examiner

*Primary Examiner*—Bruce H. Hess
(74) *Attorney, Agent, or Firm*—Sughrue Mion, PLLC

(57) ABSTRACT

In the invention, a recording material containing a support having a recording layer thereon capable of forming a color by the application of heat and/or pressure is provided, and the material further contains at least one layer containing acetoacetyl-modified polyvinyl alcohol and a hardening agent between the support and the recording layer. The hardening agent is a compound having, in one molecule thereof, two or more vinyl groups adjacent to a substituent having a positive Hammett's substituent constant σp.

20 Claims, No Drawings

RECORDING MATERIAL

BACKGROUND OF THE INVENTION

1. Field of the Invention

The present invention relates to a recording material, and more particularly, to a recording material capable of being recorded upon with a thermal head or the like.

2. Description of the Related Art

Heat-sensitive recording materials, on which images can be recorded by applying heat from a thermal head, have been significantly developed in recent years. This is due to the fact that such materials possess many advantages, particularly in that the recording apparatuses therefor are simple, reliable, and relatively maintenance-free. Conventional recording materials contain a support having a recording layer thereon containing coloring components, such as a combination of an electron donating dye precursor and an electron accepting compound, and a combination of a diazonium salt compound and a coupler. Images are recorded by utilizing the coloring component reactions, which proceed with the application of heat.

Because image formation is executed by applying heat in the heat-sensitive recording method, the surface temperature of the recording material is high during image recording. Furthermore, the recording material is pressed during image recording when a contact-type recording means, such as a thermal head, is used. At this time, water vapor and air in the recording layer expand due to the applied heat, and when the vapor and air migrate to the surface of a coating layer of the support, they expand on the coating layer to form gaps, or blisters. The formation of blisters causes deterioration in glossiness and in the image quality of the recorded image.

In order to suppress surface blisters, the formation of a layer having low permeability to gaseous water vapor, such as an undercoating layer, between the support and the recording layer has been known. The undercoating layer preferably contains a water-soluble resin, such as polyvinyl alcohol, as a binder. Furthermore, when the undercoating layer containing polyvinyl alcohol is formed on the support, the surface of the coated layer becomes flat by leveling after coating. Therefore, it is preferable to utilize a method that uses a coating solution for the undercoating layer, prepared by dissolving polyvinyl alcohol in water and then adding methanol or the like thereto.

However, even when such an undercoating layer containing polyvinyl alcohol is provided, there are cases where cracks are formed therein by physical force, and where gaseous water vapor reaches the support through the cracks to form blisters.

When the above-described recording material, which has a recording layer on a support, is immersed in water, there are cases when the recording layer is released from the support. Hence, there is a demand for improvement in water resistance and for better adhesiveness of the recording layer to the support in wet conditions.

In order to improve the water resistance and the adhesiveness of the recording layer, the formation of an undercoating layer containing a water-soluble resin, such as polyvinyl alcohol, and a hardening agent between the support and the recording layer has been known. However, there are cases where the addition of a hardening agent increases the viscosity of the coating composition for the undercoating layer and this causes problems when the undercoating layer is formed.

SUMMARY OF THE INVENTION

An object of the present invention is to solve the problems associated with the conventional art and to provide a recording material that suppresses blister formation and possesses improved water resistance.

The invention provides a recording material comprising a support having a recording layer thereon capable of forming a color with the application of heat and/or pressure. The material further comprises at least one layer containing acetoacetyl-modified polyvinyl alcohol and a hardening agent between the support and the recording layer. Here, the hardening agent is a compound having, in one molecule thereof, two or more vinyl groups adjacent to a substituent having a positive Hammett's substituent constant σp.

DETAILED DESCRIPTION OF THE PREFERRED EMBODIMENTS

The invention will be described in detail below.

The recording material of the invention has a support having a recording layer thereon capable of forming a color with the application of heat and/or pressure. The material further comprises at least one layer containing acetoacetyl-modified polyvinyl alcohol and a hardening agent between the support and the recording layer. Here, the hardening agent is a compound having, in one molecule thereof, two or more vinyl groups adjacent to a substituent having a positive Hammett's substituent constant σp.

The layer containing acetoacetyl-modified polyvinyl alcohol and a hardening agent is preferably formed as undercoating layer adjacent to the support. The layer is described below as referred to as an undercoating layer containing the acetoacetyl-modified polyvinyl alcohol and the hardening agent.

Undercoating Layer

The undercoating layer contains the acetoacetyl-modified polyvinyl alcohol and the hardening agent and is positioned between the support and the recording layer. The undercoating layer suppresses permeation of oxygen and prevents the background from coloration, and also it suppresses formation of blister and improves water immersion resistance. The components of the undercoating layer will be described in detail below.

Hardening Agent

The hardening agent used in the undercoating layer is a compound having, in one molecule thereof, two or more vinyl groups adjacent to a substituent having a positive Hammett's substituent constant σp.

Such a compound contained in the undercoating layer reacts with the acetoacetyl-modified polyvinyl alcohol described later to improve the water resistance of the recording layer without increase of the viscosity of the coating solution for the undercoating layer. As a result, a recording material that has both improved water resistance of the recording layer and improved coating stability of the coating solution for the undercoating layer can be obtained.

Examples of the substituent having a positive Hammett's substituent constant up include a $CF_3$ group (σp value: 0.54), a CN group (σp value: 0.66), a $COCH_3$ group (σp value: 0.50), a COOH group (σp value: 0.45), a COOR group (wherein R represents an alkyl group) (σp value: 0.45), an $NO_2$ group (σp value: 0.78), an $OCOCH_3$ group (σp value: 0.31), an SH group (σp value: 0.15), an $SOCH_3$ group (σp value: 0.49), an $SO_2CH_3$ group (σp value: 0.72), an $SO_2NH_2$ group (σp value: 0.57), an $SCOCH_3$ group (σp value: 0.44), an F group (σp value: 0.06), a Cl group (σp value: 0.23), a Br group (σp value: 0.23), an I group (σp value: 0.18), an $IO_2$ group (σp value: 0.76), an $N^+(CH_3)_2$ group (σp value: 0.82) and an $S(CH_3)_2$ group (σp value: 0.90).

Examples of the compound having, in one molecule thereof, two or more vinyl groups adjacent to a substituent having a positive Hammett's substituent constant up include 2-ethylenesulfonyl-N-(2-(2-ethylenesulfonyl-acetylamino)-ethyl)acetamide, bis-2-vinylsulfonylethyl ether, bisacryloylimide, N,N'-diacryloylurea, 1,1-bisvinylsulfoneethane and ethylene-bis-acrylamide, and diacrylate and dimethacrylate compounds represented by the following structural formulae. Among these, 2-ethylenesulfonyl-N-(2-(2-ethylenesulfonyl-acetylamino)-ethyl)acetamide is particularly preferable.

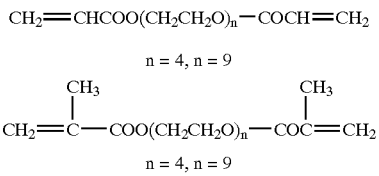

The content of the compound having, in one molecule thereof, two or more vinyl groups adjacent to a substituent having a positive Hammett's substituent constant σp in the undercoating layer is preferably from 0.1 to 30% by mass, and more preferably from 0.5 to 10% by mass, based on the amount of the acetoacetyl-modified polyvinyl alcohol.

When the content of the compound in the undercoating layer is from 0.5 to 10% by mass based on the amount of the acetoacetyl-modified polyvinyl alcohol, the effect of the compound in the invention, i.e., improvement in water resistance of the recording material without increase of the viscosity of the coating solution for the undercoating layer, is efficiently exhibited.

Acetoacetyl-modified Polyvinyl Alcohol

The acetoacetyl-modified polyvinyl alcohol (hereinafter referred to as an "acetoacetyl-modified PVA") contained in the undercoating layer has a large effect in suppression of permeation of oxygen and has high S—S characteristics. The S—S characteristics herein mean an amount of absorbed tensile energy expressed by stress and elongation until breakage of the film, i.e., toughness. Therefore, the undercoating layer exhibits the oxygen permeation suppressing effect, and also it is flexibly expanded and contracted when heated with a thermal head to prevent formation of cracks, whereby formation of blister is prevented.

The acetoacetyl-modified PVA in the invention preferably has a polymerization degree of 1,000 or more, and more preferably 1,500 or more. The polymerization degree of 1,000 or more exerts a large effect in suppression of formation cracks under a low humidity environment (e.g., 20° C. and 10%). It is considered that this is because the relatively large polymerization degree of 1,000 or more considerably increases the strength and the elongation at breakage. Furthermore, the high polymerization degree increases the viscosity of the coating solution and lowers the surface property of the coated layer, but the disadvantage can be compensated by lowering the concentration of the coating solution and the content of water dispersible mica. Although the oxygen permeability is increased by lowering the content of the water dispersible mica, it can be compensated by increasing the polymerization degree of the acetoacetyl-modified PVA.

The modification degree of the acetoacetyl-modified PVA is preferably 0.05 to 20% by mole, and more preferably from 0.05 to 15% by mole.

The saponification degree of the acetoacetyl-modified PVA is not particularly limited and is preferably 80 to 99.5%. The lower the saponification degree is, the larger the elongation at breakage. While a higher polymerization degree provides a higher saponification degree, the saponification degree is preferably low in the case of a low polymerization degree. When the saponification degree is lowered, the elongation can be increased, and the solubility of the PVA in methanol is increased to lower the viscosity of the coating solution and to improve the leveling property of the coated surface, and whereby the surface property of the coated layer can be improved.

Lamellar Inorganic Compound

It is preferable that the undercoating layer further contains a lamellar inorganic compound. A swelling inorganic lamellar compound is preferable as such, and examples thereof include swelling clay minerals, such as bentonite, hectorite, saponite, bederite, nontronite, stevensite, beidellite and montmorillonite, swelling synthetic mica and swelling synthetic smectite. These swelling inorganic lamellar compounds have a laminated structure containing unit crystalline lattice layers having a thickness of from 1 to 1.5 nm, and the extent of the intra-lattice metallic atom substitution is considerably larger than that of the other clay minerals. As a result, the lattice layer causes shortage in positive charge, and a cation, such as $Na^+$, $Ca^{2+}$ and $Mg^{2+}$, is adsorbed between the layers to compensate the shortage. The cation intervening between the layers is referred to as an exchangeable cation and is exchanged with various kinds of cations. In particular, in the case where the cation between the layers is $Li^+$ or $Na^+$, the bonding force between the lamellar crystalline lattices is small owing to the small ionic radius of the compound, and thus it is largely swelled with water. When a shearing force is applied thereto under the swelled state, it is easily cleaved to form a stable sol in water. Such a tendency is remarkable in bentonite and swelling synthetic mica, and these are preferable for the purpose in the invention. Water swelling synthetic mica is particularly preferable.

Examples of the water swelling synthetic mica include fluorotetrasilicic mica taeniolite and hectorite.

The water swelling synthetic mica that is preferably used in the invention has a thickness of from 1 to 50 nm and a plane size of from 1 to 20 μm. The thickness is preferably as small as possible in order to control dispersion thereof, and the plane size is preferably as large as possible unless the flatness and the transparency of the coated surface are impaired. Therefore, the aspect ratio thereof is generally 100 or more, preferably 200 or more, and particularly preferably 500 or more.

Mass Ratio

The mass ratio (x/y) of the mass (x) of the acetoacetyl-modified PVA and the mass (y) of the water swelling synthetic mica contained in the undercoating layer is preferably in a range of from 2 to 30, and more preferably in a range of from 5 to 15. When the mass ratio is in a range of from 2 to 30, significant effect is obtained in suppression in oxygen permeation and blister formation.

The coating amount of the PVA is preferably in a range of from 0.05 to 1.5 $g/m^2$, and more preferably in a range of from 0.3 to 1.5 $g/m^2$. The coating amount of 0.05 g or more per 1 $m^2$ provides sufficient effect of suppression in gas permeation. The coating amount of 1.5 g or less per 1 $m^2$ sufficiently assures the sensitivity and Dmax of the recording material.

Furthermore, the coating amount of the water swelling synthetic mica is preferably from 0.02 to 0.5 $g/m^2$, and more preferably from 0.05 to 0.4 g/m$^2$ in order to suppress oxygen permeation, and is preferably such a value that can be derived from the mass ratio with respect to the PVA and the coated amount of the PVA.

The undercoating layer preferably has a thickness of from 0.5 to 2.5 $\mu$m, and more preferably from 0.5 to 2.0 $\mu$m. When the thickness is in a range of from 0.5 to 2.5 $\mu$m, sufficient effect in suppressing gas permeation and sufficient Dmax are obtained, and the uniformity of the coated film is assured, and whereby high image quality is obtained.

Support

Various kinds of supports, such as a paper support, e.g., base paper and synthetic paper, and a plastic film support, may be used as the support used in the recording material of the invention. The base paper used in the paper support may be made from natural pulp, selected from conifer pulp and hardwood pulp as a main raw material, to which a filler, such as clay, talc, calcium carbonate and urea resin fine particles, a sizing agent, such as rosin, an alkylketene dimer, a higher fatty acid, an epoxidated fatty acid amide, paraffin wax and alkenyl succinic acid, a strengthening agent, such as starch, polyamidepolyamie epichlorohydrin and polyacrylamide, and a fixing agent, such as aluminum sulfate and a cationic polymer, are added depending on necessity. A softening agent, such as a surface active agent, may also be added thereto. Furthermore, synthetic paper using synthetic pulp instead of the natural pulp may be used as the paper support, and a mixture of the natural pulp and the synthetic pulp in an arbitrary proportion may also be used. Among these, hardwood pulp containing short fibers which provides high smoothness is preferably used. The water content of the pulp material used is preferably from 200 to 500 ml (C.S.F.), and more preferably from 300 to 400 ml.

The paper support may contain other component. Examples of the other component include a sizing agent, a softening agent, a strengthening agent and a fixing agent. Examples of the sizing agent include rosin, paraffin wax, a higher fatty acid salt, an alkenyl succinic acid, a fatty acid anhydride, a styrene-maleic anhydride copolymer, an aklylketene dimer and an epoxidated fatty acid amide. Examples of the softening agent include a reaction product of a maleic anhydride copolymer and polyalkylenepolyamine, and a quaternary ammonium salt of a higher fatty acid. Examples of the strengthening agent include polyacrylamide, starch, polyvinyl alcohol, a melamine-formaldehyde condensate and gelatin. Examples of the fixing agent include aluminum sulfate and polyamide-polyamie epichlorohydrin. In addition, a dye, a fluorescent dye and an antistatic agent may be added depending on necessity.

As the support of the recording material of the invention, a laminated support in which base paper (paper substrate) is disposed between polyolefin layers is preferable. The laminated support is preferable since the surface smoothness of the support is improved, and whereby a vertical interval in thickness on the image portions caused by variation in image density, i.e., so-called blister, can be suppressed. Polyethylene is preferably used as the polyolefin.

The polyolefin layers can be formed on both surfaces of the base paper by a lamination process. The lamination process can be appropriately selected from the known methods, such as those disclosed in "Shin-laminate Processing Handbook" (New Lamination Processing Handbook), edited by Kako Gijutsu Kenkyukai (Processing Technique Workshop), and so-called dry lamination method, non-solvent dry lamination method, hot-melt lamination method and the like can be employed. For example, when the polyolefin layers are formed by dry lamination, an adhesive is applied to one surface of each of polyolefin resin films, followed by drying depending on necessity, and the films are bonded to the surface of the base paper while heat and pressure are applied to the films and the base paper to form the polyolefin layers. Examples of the adhesive include a solvent type vinyl resin, an acrylic resin, a polyamide resin, an epoxy resin, a rubber resin and a urethane resin. It is possible that the front surface and/or the back surface of the base paper are subjected to a corona discharge treatment to improve adhesiveness to the polyolefin layer.

Recording Layer

The recording material of the invention has a recording layer capable of forming a color by application of heat and/or pressure. In the case of a recording material for forming a multi-color image, the recording material has two or more recording layers capable of forming respective colors by application of heat and/or pressure. In particular, differences in amounts of energy to be applied to the respective recording layers are provided to form prescribed colors in the case of a recording material for forming a multi-color image, and therefore, formation of blister is significant at the time of printing with high printing energy. The recording material of the invention can be prevented from formation of blister owing to the prevention effect of gas (water vapor) permeation of the undercoating layer, and can provide good image quality of the multi-color image.

In the recording material for forming a multi-color image, for example, recording layers which form cyan, magenta and yellow colors are formed to obtain a recording material capable of forming a full color image. In the multi-color recording material of the invention, for example, structures and recording methods disclosed in columns 36 to 38 of Japanese Patent Application Laid-Open (JP-A) No. 11-34495 can be applied.

The recording layer preferably contains color-forming components that are colorless under an ordinary temperature and ordinary pressure but form a color by application of heat and/or pressure. Examples of the color-forming components include the following combinations (a) to (r).

(a) Combination of an electron donating dye precursor and an electron accepting compound (b) Combination of a diazo compound and a coupling component (hereinafter sometimes referred to as a "coupler compound")

(c) Combination of an organic acid metallic salt, such as silver behenate and silver stearate, and a reducing agent, such as protocatechinic acid, spiroindane and hydroquinone (d) Combination of a long-chain fatty acid iron salt, such as ferric stearate and ferric myristate, and a phenol, such as tannic acid, gallic acid and ammonium salicylate (e) Combination of an organic acid heavy metallic salt, such as a nickel, cobalt, lead, copper, iron, mercury or silver salt of acetic acid, stearic acid and palmitic acid, and an alkali metal or alkaline earth metal sulfide, such as calcium sulfide, strontium sulfide and potassium sulfide, or combination of the organic acid heavy metallic salt and an organic chelating agent, such as s-diphenyl carbazide and diphenylcarbazone (f) Combination of a heavy metal sulfate, such as sulfates of silver, lead, mercury and sodium, and a sulfur compound, such as sodium tetrathionate, sodium thiosulfate and thiourea (g) Combination of a fatty acid ferric salt, such as ferric stearate, and an aromatic polyhydroxy compound, such as 3,4-hydroxytetraphenylmethane (h) Combination of an organic acid metallic salt, such as silver oxalate and mercury oxalate, and an organic polyhydroxy compound, such as polyhydroxy alcohol, glycerin and glycol (i) Combination of a fatty acid ferric salt, such as ferric pelargonate and ferric laurate, and thiocetylcarbamide or a isothiocetylcabamide derivative (j) Combination of an organic acid lead salt, such as lead caproate, lead pelargonate and lead behenate, and a thiourea derivative, such as ethylene thiourea and N-dodecyl thiourea (k) Combination of a higher fatty acid heavy metallic salt, such as ferric stearate and copper stearate, and zinc dialkyldithiocarbamate (l) Combination of compounds forming a dioxazine dye, such as combination of resorcin and a nitroso compound (m) Combination of a formazan compound and a reducing agent and/or a metallic salt (n) Combination of a protected dye (or leuco dye) precursor and a deprotecting agent (o) Combination of an oxidation type color-forming agent and an oxidizing agent (p) Combination of a phthalonitrile compound and a diiminoisoindoline compound (i.e., combination of compounds forming phthalocyanine)

(q) Combination of an isocyanate compound and a diiminoisoindoline compound (i.e., combination of compounds forming a colored pigment)

(r) Combination of a pigment precursor and an acid or a base (i.e., combination of compounds forming a pigment)

The color-forming components are preferably the combination of an electron donating dye precursor and an electron accepting compound (a), and the combination of a diazo compound and a coupling component (b).

Electron Donating Dye Precursor

Examples of the electron donating dye precursor used in the combination (a) include a phthalide compound, a fluoran compound, a phenothiazine compound, an indolyl phthalide compound, a leucoauramine compound, a rhodamine lactam compound, a triphenylmethane compound, a triazene compound, a spiropyran compound, a pyridine compound, a pyrazine compound and a fluorene compound.

Examples of the phthalide compound include compounds described in U.S. Reissue Pat. No. 23,024, U.S. Pat. Nos. 3,491,111, 3,491,112, 3,491,116 and 3,509,174, and specific examples thereof include 3,3-bis(p-dimethylaminophenyl)-6-dimethylaminophthalide, 3,3-bis(p-diemethylaminophenyl)phthalide, 3-(p-dimethylaminophenyl)-3-(1,3-dimethylindole-3-yl) phthalide and 3-(p-dimethylaminophenyl)-3-(2-methylindole-3-yl)phtalide.

Examples of the fluoran compound include compounds described in U.S. Pat. Nos. 3,624,107, 3,627,787, 3,641,011, 3,462,828, 3,681,390, 3,920,510 and 3,959,571, and specific examples thereof include 2-(dibenzylamino)fluoran, 2-anilino-3-methyl-6-diethylaminofluoran, 2-anilino-3-methyl-6-dibutylaminofluoran, 2-anilino-3-methyl-6-N-ethyl-N-isoamylaminofluoran, 2-anilino-3-methyl-6-N-methyl-N-cyclohexylaminofluoran, 2-anilino-3-chloro-6-diethylaminofluoran, 2-anilino-3-methyl-6-N-ethyl-N-isobutylaminofluoran, 2-anilino-6-dibutylaminofluoran, 2-anilino-3-methyl-6-N-methyl-N-tetrahydrofurfurylaminofluoran, 2-anilino-3-methyl-6-piperidinoaminofluoran, 2-(o-chloroanilino)-6-diethylaminofluoran and 2-(3,4-dichloroanilino)-6-diethylaminofluoran.

Examples of the thiazine compound include benzoyl leucomethylene blue and p-nitrobenzyl leucomethylene blue.

Examples of the leucoauramine compound include 4,4'-bis-dimethylaminobenzhydrin benzyl ether, N-halophenyl-leucoauramine and N-2,4,5-trichlorophenyl leucoauramine.

Examples of the rhodamine lactam compound include rhodamine-B-anilinolactam and rhodamine-(p-nitro)lactam.

Examples of the spiropyran compound include compounds described in U.S. Pat. No. 3,971,808, and specific examples thereof include 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)spiropyran and 3-propyl-spiro-dibenzopyran.

Examples of the pyridine compound and the pyrazine compound include compounds described in U.S. Pat. Nos. 3,775,424, 3,853,869 and 4,246,318.

Examples of the fluorene compound include compounds described in Japanese Patent Application No. 61-240989.

Dye precursors described in U.S. Pat. No. 4,800,149 can be used as the dye precursor forming cyan, magenta or yellow color. Dye precursors described in U.S. Pat. No. 4,800,148 can be used as the electron donating dye precursor forming yellow color, and dye precursors described in JP-A No. 63-53542 can be used as the electron donative dye precursor forming cyan color.

Electron Accepting Compound

Examples of the electron accepting compound used in the combination (a) include a phenol derivative, a salicylic acid derivative, a metallic salt of an aromatic carboxylic acid, acid clay, bentonite, a novolak resin, a metal-treated novolak resin and a metallic complex, which have been known as electron accepting compounds. They are specifically described in JP-B Nos. 40-9309 and 45-14039, and JP-A Nos. 52-140483, 48-51510, 57-210886, 58-87089, 59-11286, 60-176795 and 61-95988.

Among the foregoing, examples of the phenol derivative include 2,2'-bis(4-hydroxyphenyl)propane, 4-t-butylphenol, 4-phenylphenol, 4-hydroxydiphenoxide, 1,1'-bis(3-chloro-4-hydroxyphenyl)cyclohexane, 1,1'-bis(4-hydroxyphenyl) cyclohexane, 1,1'-bis(3-chloro-4-hydroxyphenyl)-2-ethylbutane, 4,4'-sec-isooctylidenediphenol, 4,4'-sec-butylidenediphenol, 4-tert-octylphenol, 4-p-methylphenylphenol, 4,4'-methylcyclohexylidenephenol, 4,4'-isopentylidenephenol and benzyl p-hydroxybenzoate.

Examples of the salicylic acid derivative include 4-pentadecylsalicylic acid, 3,5-di(α-methylbenzyl)salicylic acid, 3,5-di(tert-octyl)salicylic acid, 5-octadecylsalicylic acid, 5-α-(p-α-methylbenzylphenyl)ethylsalicylic acid, 3-α-methylbenzyl-5-tert-octylsalicylic acid, 5-tetradecylsalycylic acid, 4-hexyloxysalicylic acid, 4-cyclohexyloxysalicylic acid, 4-decyloxysalicylic acid, 4-dodecyloxysalicylic acid, 4-pentadecyloxysalicylic acid, 4-octadecyloxysalicylic acid, and zinc, aluminum, calcium, copper and lead salts thereof.

In the case where the combination of the electron donating dye precursor and the electron accepting compound is used as the color-forming components, the electron donating dye precursor is preferably contained in the recording layer in an amount of from 0.1 to 5 g/m$^2$, and more preferably from 0.1 to 1 g/m$^2$. The electron accepting compound is preferably used in an amount of from 0.5 to 20 parts by mass, and more preferably from 3 to 10 parts by mass, per 1 part by mass of the electron donating dye precursor used. When the amount is less than 0.5 part by mass, a sufficient coloring density cannot be obtained, and when it exceeds 20 parts by mass, the sensitivity is lowered, and the coating aptitude is deteriorated.

Diazo Compound

A compound represented by the following general formula is preferably used as the diazo compound that can be used in the combination (b).

$Ar—N_2^+.Y^-$ wherein Ar represents an aromatic ring group, and $Y^-$ represents an acid anion.

In the forgoing general formula, Ar represents a substituted or unsubstituted aryl group. Examples of the substituent include an alkyl group, an alkoxy group, an alkylthio group, an aryl group, an aryloxy group, an arylthio group, an acyl group, an alkoxycarbonyl group, a carbamoyl group, a carboamide group, a sulfonyl group, a sulfamoyl group, a sulfonamide group, a ureido group, a halogen atom, an amino group and a heterocyclic group, and these substituents may be further substituted.

The aryl group preferably has from 6 to 30 carbon atoms, and examples thereof include a phenyl group, a 2-methylphenyl group, a 2-chlorophenyl group, a 2-methoxyphenyl group, a 2-butoxyphenyl group, a 2-(2-ethylhexyloxy)phenyl group, a 2-octyloxyphenyl group, a 3-(2,4-di-t-pentylphenoxyethoxy)phenyl group, a 4-chlorophenyl group, a 2,5-dichlorophenyl group, a 2,4,6-trimethylphenyl group, a 3-chlorophenyl group, a 3-methylphenyl group, a 3-methoxyphenyl group, a 3-butoxyphenyl group, a 3-cyanophenyl group, a 3-(2-ethylhexyloxy)phenyl group, a 3, 4-dichlorophenyl group, a 3,5-dichlorophenyl group, a 3,4-dimethoxyphenyl group, a 3-(dibutylaminocarbonylmethoxy)phenyl group, a 4-cyanophenyl group, a 4-methylphenyl group, a 4-methoxyphenyl group, a 4-butoxyphenyl group, a 4-(2-ethylhexyloxy)phenyl group, a 4-benzylphenyl group, a 4-aminosulfonylphenyl group, a 4-N,N-dibutylaminosulfonylphenyl group, a 4-ethoxycarbonylphenyl group, a 4-(2-ethylhexylcarbonyl) phenyl group, a 4-fluorophenyl group, a 3-acetylphenyl group, a 2-acetylaminophenyl group, a 4-(4-chlorophenylthio)phenyl group, a 4-(4-methylphenyl)thio-2,5-butoxyphenyl group and a 4-(N-benzyl-N-methylamino)-2-dodecyloxycarbonylphenyl group. These groups may be further substituted with an alkyloxy group, an alkylthio group, a substituted phenyl group, a cyano group, a substituted amino group, a halogen atom or a heterocyclic group.

Examples of a diazo compound that can be preferably used as the color-forming component include diazo compounds disclosed in the columns 44 to 49 of JP-A No. 7-276808.

The diazo compound preferably has a maximum absorption wavelength $\lambda_{max}$ of 450 nm or less, and more preferably from 290 to 440 nm. It is preferable that the diazo compound has 12 or more carbon atoms, has a solubility in water of 1% or less, and has a solubility in ethyl acetate of 5% or more.

In the invention, the diazo compound may be used alone or may be used in combination of two or more of them for various purposes, such as adjustment of hue.

Coupler Compound

The coupler compound used in the combination (b) forms a dye through coupling with the diazo compound under a basic atmosphere and/or a neutral atmosphere, and they can be used in combination of plural kinds thereof for various purposes, such as adjustment of hue. An active methylene compound having a methylene group adjacent to a carbonyl group, a phenol derivative and a naphthol derivative are preferably used as the coupler compound. Specific examples thereof include resorcin, phloroglucin, 2,3-dihydroxynaphthalene, sodium 2,3-dihydroxynaphthalene-6-sulfonate, 1-hydroxy-2-naphthoic acid morpholinopropylamide, sodium 2-hydroxy-3-naphthalenesulfonate, 2-hydroxy-3-naphthalenesulfonic acid anilide, 2-hydroxy-3-naphthalenesulfonic acid morpholinopropylamide, 2-hydroxy-3-naphthalenesulfonic acid 2-ethylhexyloxypropylamide, 2-hydroxy-3-naphthalenesulfonic acid 2-ethylhexylamide, 5-acetamide-1-naphthol, sodium 1-hydroxy-8-acetamidenaphthalene-3,6-disulfonate, 1-hydroxy-8-aceamidenaphthalene-3,6-disulfonic acid dianilide, 1,5-dihydroxynaphthalene, 2-hydroxy-3-naphthoic acid morpholinopropylamide, 2-hydroxy-3-naphthoic acid octylamide, 2-hydroxy-3-naphthoic acid anilide, 5,5-dimethyl-1,3-cyclohexanedione, 1,3-cyclopentanedione, 5-(2-n-tetradecyloxyphenyl)-1,3-cyclohexanedione, 5-phenyl-4-methoxycarbonyl-1,3-cyclohexanedione, 0.5-(2,5-di-n-octyloxyphenyl)-1,3-cyclohexanedione, N,N'-dicyclohexylbarbituric acid, N,N'-di-n-dodecylbarbituric acid, N-n-octyl-N'-n-octadecylbarbituric acid, N-phenyl-N'-(2,5-di-n-octyloxyphenyl)barbituric acid, N,N'-bis (octadecyloxycarbonylmethyl)barbituric acid, 1-phenyl-3-methyl-5-pyrazolone, 1-(2,4,6-trichlorophenyl)-3-anilino-5-pyrazolone, 1-(2,4,6-trichlorophenyl)-3-benzamide-5-pyrazolone, 6-hydroxy-4-methyl-3-cyano-1-(2-ethylhexyl)-2-pyridone, 2,4-bis(benzoylacetamide)toluene, 1,3-bis (pivaloylacetamidemethyl)benzene, benzoylacetonitrile, thenoylacetonitrile, acetoacetanilide, benzoylacetanilide, pivaloylacetanilide, 2-chloro-5-(N-n-butylsulfamoyl)-1-pivaloylacetoamidebenzene, 1-(2-ethylhexyloxypropyl)-3-cyano-4-methyl-6-hydroxy-1,2-dihydropyridin-2-one, 1-(dodecyloxypropyl)-3-acetyl-4-methyl-6-hydroxy-1,2-dihydropyridin-2-one and 1-(4-n-octyloxyphenyl)-3-tert-butyl-5-aminopyrazole.

Details of the coupler compound can be referred in JP-A Nos. 4-201483, 7-223367, 7-223368, 7-323660, 5-278608, 5-297024, 6-18669, 6-18670, 7-316280, 9-216468, 9-216469, 9-319025, 10-035113, 10-193801 and 10-264532.

In the case where the combination of the diazo compound and the coupler compound is used as the color-forming compounds, it is preferable that the diazo compound is contained in the recording layer in an amount of from 0.02 to 5.0 g/m$^2$, and more preferably from 0.05 to 3.0 g/m$^2$. When the content is less than 0.02 g/m$^2$, a sufficient coloring density cannot be obtained, and when it exceeds 5.0 g/m$^2$, the coating aptitude of the coating solution is deteriorated. The use amount of the coupler compound is preferably from 0.5 to 20 parts by mass, and more preferably from 1 to 10 parts by mass, per 1 part by mass of the diazo compound. When the use amount is less than 0.5 part by mass, a sufficient coloring density cannot be obtained, and when it exceeds 20 parts by mass, the coating aptitude of the coating solution is deteriorated.

The coupler compound can be used (along with other components to be added depending on necessity) in such a manner that a water soluble polymer is added thereto, and that they are subjected to solid dispersion by using, for example, a sand mill, or in alternative, it can be used as an emulsion by emulsifying with a suitable emulsifying assistant. The methods for the solid dispersion and the emulsification are not particularly limited, and known processes can be employed. Details of the methods are described in JP-A Nos. 59-190886, 2-141279 and 7-17145.

Organic Base

In order to accelerate the coupling reaction between the diazo compound and the coupler, it is preferable to use an organic base, such as a tertiary amine, a piperidine, a piperazine, an amidine, a formamidine, a pyridine, a guanidine and a morpholine. Examples of the organic base include a piperazine compound, such as N,N'-bis(3-phenoxy-2-hydroxypropyl)piperazine, N,N'-bis(3-(p-methylphenoxy)-

2-hydroxypropyl)piperazine, N,N'-bis[3-(p-methoxyphenoxy)-2-hydroxypropyl]piperazine, N,N'-bis(3-phenylthio-2-hydroxypropyl)piperazine, N,N'-bis[3-(β-naphthoxy)-2-hydroxypropyl]piperazine, N-3-(β-naphthoxy)-2-hydroxypropyl-N'-methylpiperazine and 1,4-bis{[3-(N-methylpiperazino)-2-hydroxy]propyloxy}benzene; a morpholine compound, such as N-(3-(β-naphthoxy)-2-hydroxy)propylmorpholine, 1,4-bis((3-morpholino-2-hydroxy)propyloxy)benzene and 1,3-bis((3-morpholino-2-hydroxy)propyloxy)benzene; a piperidine compound, such as N-(3-phenoxy-2-hydroxypropyl) piperidine and N-dodecylpiperidine; triphenylguanidine, tricyclohexylguanidine, dicyclohexylphenylguanidine, 2-N-methyl-N-benzylaminoethyl 4-hydroxybenzoate, 2-N,N-di-n-butylaminoethyl 4-hydroxybenzoate, 4-(3-N,N-dibutylaminopropoxy)benzenesulfonamide and 4-(2-N,N-dibutylaminoethoxycarbonyl)phenoxyacetic acid amide.

These organic bases can be used alone or in combination of two or more of them.

The organic bases are described in JP-A Nos. 57-123086, 60-49991, and 60-94381, and Japanese Patent Application Nos. 7-228731, 7-235157 and 7-235158.

The use amount of the organic base is not particularly limited, and it is preferably from 1 to 30 mole per mole of the diazo compound.

Color-forming Assistant

Furthermore, in order to accelerate the color-forming reaction, a color-forming assistant may be added.

Examples of the color-forming assistant include a phenol derivative, a naphthol derivative, an alkoxy-substituted benzene, an alkoxy-substituted naphthalene, a hydroxyl compound, a carboxylic acid amide compound and a sulfonamide compound.

Binder

The recording layer may contain a binder along with the color-forming component. A water soluble material is generally used as the binder, and examples thereof include polyvinyl alcohol, hydroxyethyl cellulose, hydroxypropyl cellulose, an ethylene-maleic anhydride copolymer, a styrene-maleic anhydride copolymer, an isobutylene-maleic anhydride copolymer, polyacrylic acid, a starch derivative, casein and gelatin. In order to impart water resistance to the binder, a water resistance-imparting agent (such as a gelling agent and a crosslinking agent) may be added, and an emulsion of a hydrophobic polymer, such as styrene-butadiene rubber latex and an acrylic resin emulsion, may be added. The binder is preferably contained in the recording layer in an amount of from 10 to 30% by mass in terms of dry mass.

Others

In the recording layer, a defoaming agent, a fluorescent dye, a colored dye, an inorganic pigment, wax, a higher fatty acid amide, a metallic soap, an ultraviolet ray absorbent, an antioxidant and a latex binder may be added depending on necessity. Furthermore, various kinds of additives that are used in heat-sensitive recording materials and pressure-sensitive recording materials can be contained in the recording layer or in the other layers. Examples of the additives include compounds disclosed in JP-A Nos. 60-125470, 60-125471, 60-125472, 60-287485, 60-287486, 60-287487, 62-146680, 60-287488, 62-282885, 63-89877, 63-88380, 63-88381, 1-239282, 4-291685, 4-291684, 5-188687, 5-188686, 5-110490, 5-1108437, 5-170361, 63-203372, 63-224989, 63-267594, 63-182484, 60-107384, 60-107383, 61-160287, 61-185483, 61-211079, 63-251282 and 63-51174, and JP-B Nos. 48-43294 and 48-33212.

Microcapsules

In order that the recording layer forms a color by application of heat and/or pressure, it is preferable that the color-forming reaction of the coloring components is imparted with heat responsiveness and/or pressure responsiveness. For example, one of the color-forming components is encompassed in microcapsules having heat responsiveness and/or pressure responsiveness to make the color-forming reaction heat responsive and/or pressure responsive. As a method for microcapsulation of the color-forming component, known methods can be employed. Examples thereof include a method utilizing coacervation of a hydrophilic wall forming material described in U.S. Pat. Nos. 2,800,457 and 2,800,458; an interface polymerization method described in U.S. Pat. No. 3,287,154, British Patent No. 990,443, JP-B Nos. 38-19574, 42-446 and 42-771; a method using polymer deposition described in U.S. Pat. Nos. 3,418,250 and 3,660,304; a method using an isocyanate polyol wall material described in U.S. Pat. No. 3,796,669; a method using an isocyanate wall material described in U.S. Pat. No. 3,914,511; a method using a urea-formaldehyde wall forming material or a urea formaldehyde-resorcinol wall forming material described in U.S. Pat. Nos. 4,001,140, 4,087,376 and 4,089,802; a method using a wall forming material, such as a melamine-formaldehyde resin and hydroxypropyl cellulose, described in U.S. Pat. No. 4,025,455; an in situ process by polymerization of a monomer described in JP-B No. 36-9168 and JP-A No. 51-9079; an electrolytic dispersion cooling method described in British Patent Nos. 952,807 and 965,074; and a spray drying method described in U.S. Pat. No. 3,111,407 and British Patent No. 930,422.

The interface polymerization method is preferably used as the method for microencapsulating the color-forming component. In the interface polymerization method, one of the color-forming components (i.e., the electron donating dye precursor in the combination (a) or the diazo compound in the combination (b)) is dissolved or dispersed in a hydrophobic organic solvent, which becomes a core of capsules, to form an oily phase, and the oily phase is mixed with an aqueous phase formed by dissolving a water soluble polymer in water, and the mixture is subjected to emulsion dispersion by means, such as a homogenizer, and then heated to cause a polymer forming reaction at an interface of oil droplets and to form a microcapsule wall of a polymer substance. According to the method, capsules having a uniform particle diameter can be formed in a short period of time, and a recording material excellent in storage stability can be obtained.

A reactant forming the polymer is added to the interior of the oil droplets and/or the exterior of the oil droplets. Specific examples of the polymer substance include polyurethane, polyurea, polyamide, polyester, polycarbonate, a urea-formaldehyde resin, a melamine resin, polystyrene, a styrene-methacrylate copolymer and a styrene-acrylate copolymer. Among these, polyurethane, polyurea, polyamide, polyester and polycarbonate are preferable, and polyurethane and polyurea are particularly preferable. These polymer substances may be used in combinations of two or more.

Examples of the water soluble polymer include gelatin, polyvinyl pyrrolidone and polyvinyl alcohol. For example, in the case where polyurethane is used as the capsule wall material, a polyvalent isocyanate and a second material forming the capsule wall through reaction with the polyvalent isocyanate (such as a polyol and a polyamine) are mixed with an aqueous solution of a water soluble polymer (aqueous phase) or an oily medium to be encapsulated (oily phase), and the aqueous phase and the oily phase are emulsified, and then a polymer forming reaction is effected at an interface of the oil droplets by heating the resultant emulsion, and whereby the microcapsule wall is thus formed. The particle diameter of the microcapsules is preferably from 0.1 to 1.0 μm, and more preferably from 0.2 to 0.7 μm.

Moreover, a method in which a heat fusible substance having a low melting point is mixed with one of the color-forming components (for example, the electron accepting compound in the combination (a) or the coupler compound, which is sometimes referred to as a "developer", in the combination (b)), and the mixture is added to the recording layer as an eutectic mixture, and a method in which developer particles on the surface of which a low melting point compound is fused are added to the recording layer can also be used as another method for imparting the color-forming reaction with heat responsiveness. Examples of the low melting point compound used include wax, and examples of the wax include paraffin wax, carnauba wax, microcrystalline wax and polyethylene wax, a higher fatty acid amide, such as stearic amide and ethylenebisstearoamide, and a higher fatty acid ester.

Forming Method

The recording layer can be formed by dissolving and/or dispersing the color-forming components and, if necessary, other component, such as a binder, in a solvent to form a coating solution, coating the resin film with the coating solution and drying the coating layer. Known coating methods, such as a blade coating method, an air knife coating method, a gravure coating method, a roll coating method, a spray coating method, a dip coating method, a bar coating method and an extrusion coating method, can be employed as the coating method of the coating solution.

The coating amount of the coating solution for forming the recording layer is not particularly limited, and it is generally preferably from 3 to 15 g/m$^2$, and more preferably from 4 to 10 g/m$^2$, in terms of dry mass.

In the recording material of the invention, an intermediate layer may be provided between the two recording layers, and a protective layer and an ultraviolet ray (light transmittance) adjusting layer may be provided on the recording layer depending on necessity. Examples of the materials contained in the respective layers and the arrangement of the layers are disclosed in the columns 39 to 60 of JP-A No. 11-34495.

EXAMPLES

The invention will be described in more detail below with reference to specific examples thereof, but the invention is not limited thereto. In the examples, all "parts" and "percents" mean "parts by mass" and "percents by mass", respectively, unless otherwise indicated.

Example 1

Preparation of Coating Solution for Undercoating Layer (1) Preparation of Acetoacetyl-modified Polyvinyl Alcohol Solution 12.85 parts of acetoacetyl-modified polyvinyl alcohol (saponification degree: 95 to 97%, polymerization degree: about 1,000, trade name; Gohsefimer Z-210, produced by Nippon Synthetic Chemical Industry Co., Ltd.) was added to and dissolved in 87.15 parts of water while stirring the mixture at 80° C. or more to prepare an aectoacetyl-modified polyvinyl alcohol solution having a concentration of 12.85%.

(2) Preparation of Mica Dispersion

A 8% solution of 8% water swelling synthetic mica aqueous dispersion (having an average particle diameter of 2.0 μm, aspect ratio: 1,000, trade name; Somasif MEB-3, produced by Coop Chemical Co., Ltd.) was prepared.

(3) Preparation of Surface Active Agent Solution

A 1.66% methanol solution of an ethylene oxide surface active agent ($C_{12}H_{25}O(CH_2CH_2O)_{10}H$, trade name; Emalex 710, produced by Nihon Emulsion Co., Ltd.) was prepared.

(4) Preparation of Hardening Agent Solution

A 4% aqueous solution of 2-ethylenesulfonyl-N-[2-(2-ethylenesulfonyl-acetylamino)ethyl]acetamide was prepared.

Eight parts of water and 76 parts of methanol were added to 100 parts of the 12.85% acetoacetyl-modified polyvinyl alcohol solution prepared in the item (1) and the resultant mixture was sufficiently stirred, and then 19.0 parts of the 8% mica dispersion prepared in the item (2) was added thereto and the mixture was sufficiently stirred. Three parts of the 1.66% surface active agent solution prepared in the item (3) and 3.0 parts of the 4% 2-ethylenesulfonyl-N-[2-(2-ethylenesulfonyl-acetylamino)ethyl]acetamide aqueous solution prepared in the item (4) were added thereto. The liquid temperature of the mixture was maintained at a temperature of from 30 to 40° C. to obtain a coating solution for an undercoating layer having a concentration of 7.0%.

One surface of a support for photographic paper formed by laminating polyester films on woodfree paper was subjected to a corona discharge treatment, and the resulting coating solution for an undercoating layer was applied thereto with a gravure roll of diagonal 100 mesh to a coated amount of 0.9 g/m$^2$ to provide an undercoating layer. At this time, the mass ratio (x/y) of the mass (x) of the acetoacetyl-modified PVA and the mass (y) of the water swelling synthetic mica was 8.5.

Formation of Recording Layer

Preparation of Coating Solution for Recording Layer A

Preparation of Electron Donating Dye Precursor Capsule Liquid 3.0 parts of crystal violet lactone as an electron donating dye precursor was dissolved in 20 parts of ethyl acetate, and 20 parts of alkylnaphthalene as a high boiling point solvent was added thereto, and they were uniformly mixed while heating them. Twenty parts of xylylenediisocyanate-trimethylolpropane adduct as a capsule wall material was added to the solution, followed by uniformly stirred, to obtain an electron donating dye precursor solution.

54 parts of a 6% aqueous solution of gelatin was separately prepared and added to the electron donating dye precursor solution, and they were subjected to emulsion dispersion with a homogenizer. 68 parts of water was added to the resulting emulsion, and after uniformizing, the mixture was heated to 50° C. while stirring to carry out a capsulation reaction for 3 hours, and whereby an objective electron donating dye precursor capsule liquid was obtained. The capsules had an average particle diameter of 1.6 μm.

Preparation of Electron Accepting Compound Dispersion 30 parts of bisphenol A as an electron accepting compound was added to 150 parts of a 4% gelatin aqueous solution, followed by dispersing for 24 hours with a ball mill, to prepare an electron accepting compound dispersion. The electron accepting compound in the dispersion had an average particle diameter of 1.2 μm.

Preparation of Coating Solution

The electron donating dye precursor capsule liquid and the electron accepting compound dispersion were mixed at a ratio of the electron donating dye precursor and the electron accepting compound of 1/2 to prepare an objective coating solution for a recording layer A.

Preparation of Coating Solution for Recording Layer B

Preparation of Diazonium Salt Compound Capsule Liquid b 2.0 parts of 4-(N-(2,4-di-tert-amylphenoxy)butyryl) piperadino-benzenediazonium hexafluorophosphate as a diazonium salt compound was dissolved in 20 parts of ethyl acetate, and 20 parts of alkylnaphthalene as a high boiling point solvent was added thereto, and they were uniformly mixed while heating them. 15 parts of xylylenediisocyanate-trimethylolpropane adduct as a capsule wall material was added to the solution, followed by uniformly stirred, to obtain diazonium salt compound solution.

54 parts of a 6% aqueous solution of gelatin was separately prepared and added to the diazonium salt compound solution, and they were subjected to emulsion dispersion with a homogenizer. 68 parts of water was added to the resulting emulsion, and after uniformizing, the mixture was heated to 40° C. while stirring to carry out a capsulation reaction for 3 hours, and whereby an objective diazonium salt compound capsule liquid b was obtained. The capsules had an average particle diameter of 1.1 μm.

Preparation of Coupler Emulsion b 2 parts of 1-(2'-octylphenyl)-3-methyl-5-pyrazolone as a coupler, 2 parts of 1,2,3-triphenylguanidine, 2 parts of 1,1-(p-hydroxyphenyl)-2-ethylhexane, 4 parts of 4,4'-(p-phenylenediisopropylidene)diphenol, 4 parts of 2-ethylhexyl-4-hydroxybenzoate, 0.3 part of tricresyl phosphate, 0.1 part of diethyl maleate and 1 part of a 70% methanol solution of calcium dodecylbenzenesulfonate were dissolved in 10 parts of ethyl acetate, and the resulting solution was added to 80 parts of a 8% gelatin aqueous solution, followed by emulsifying with a homogenizer for 10 minutes. Ethyl acetate was removed therefrom to obtain an objective coupler emulsion b.

Preparation of Coating Solution

The diazonium salt compound capsule liquid b and the coupler emulsion b were mixed at a ratio of the diazonium salt compound and the coupler of 2/3 to prepare an objective coating solution for a recording layer B.

Preparation of Coating Solution for Recording Layer C

Preparation of Diazonium Salt Compound Capsule Liquid c 3.0 parts of 2,5-dibutoxy-4-tolylthiobenzenediazonium hexafluorophosphate as a diazonium salt compound was dissolved in 20 parts of ethyl acetate, and 20 parts of alkylnaphthalene as a high boiling point solvent was added thereto, and they were uniformly mixed while heating them. 15 parts of xylylenediisocyanate-trimethylolpropane adduct as a capsule wall material was added to the solution, followed by uniformly stirred, to obtain diazonium salt compound solution.

54 parts of a 6% aqueous solution of gelatin was separately prepared and added to the diazonium salt compound solution, and they were subjected to emulsion dispersion with a homogenizer. 68 parts of water was added to the resulting emulsion, and after uniformizing, the mixture was heated to 40° C. while stirring to carry out a capsulation reaction for 3 hours, and whereby an objective diazonium salt compound capsule liquid c was obtained. The capsules had an average particle diameter of 1.0 μm.

Preparation of Coupler Emulsion c 2 parts of 2-chloro-5-(3-(2,4-di-tert-pentyl) phenoxypropylamino)-acetoacetanilide as a coupler, 2 parts of 1,2,3-triphenylguanidine, 2 parts of 1,1-(p-hydroxyphenyl)-2-ethylhexane, 4 parts of 4,4'-(p-phenylenediisopropylidene)diphenol, 4 parts of 2-ethylhexyl-4-hydroxybenzoate, 0.3 part of tricresyl phosphate, 0.1 part of diethyl maleate and 1 part of a 70% methanol solution of calcium dodecylbenzenesulfonate were dissolved in 10 parts of ethyl acetate, and the resulting solution was added to 80 parts of a 8% gelatin aqueous solution, followed by emulsifying with a homogenizer for 10 minutes. Ethyl acetate was removed therefrom to obtain an objective coupler emulsion c.

Preparation of Coating Solution

The diazonium salt compound capsule liquid c and the coupler emulsion c were mixed at a ratio of the diazonium salt compound and the coupler of 4/5 to prepare an objective coating solution for a recording layer C.

Preparation of Coating Solution for Light Transmittance Adjusting Layer

Preparation of Ultraviolet Ray Absorbent Precursor Capsule Liquid 10 parts of [2-allyl-6-(2H-benzotriazol-2-yl)-4-t-octylphenyl]benzenesulfonate as ultraviolet ray absorbent precursor, 3 parts of 2,5-di-t-octyl-hydroquinone, 2 parts of tricresyl phosphate and 4 parts of α-methylstyrene dimer were dissolved in 30 parts of ethyl acetate. 20 parts of xylylenediisocyanate-trimethylolpropane adduct as a capsule wall material was added to the solution, followed by uniformly stirred, to obtain an ultraviolet ray absorbent precursor solution.

200 parts of 8% aqueous solution of itaconic acid-modified polyvinyl alcohol was separately prepared, to which the ultraviolet ray absorbent precursor solution was added. The mixture was subjected to emulsion dispersion with a homogenizer. 120 parts of water was added to the resulting emulsion, and after uniformizing, the mixture was heated to 40° C. while stirring to carry out a capsulation reaction for 3 hours, and whereby an objective ultraviolet ray absorbent precursor capsule liquid was obtained. The capsules had an average particle diameter of 0.3 μm.

Preparation of Coating Solution

Preparation of Coating Solution for Light Transmittance Adjusting Layer 10 parts of a 10% aqueous solution of 2% sodium (4-nonylphenoxytrioxyethylene)butylsulfonate was added to 100 parts of the ultraviolet ray absorbent precursor capsule liquid to prepare a coating solution for a light transmittance adjusting layer.

Preparation of Coating Solution for Intermediate Layer 2 parts of a 2% aqueous solution of sodium (4-nonylphenoxytrioxyethylene)butylsulfonate was added to 100 parts of a 10% gelatin aqueous solution to prepare a coating solution for an intermediate layer.

Preparation of Coating Solution for Protective Layer 2.0 parts of a 20.5% zinc stearate dispersion (Hydrin F115, produced by Chukyo Yushi Co., Ltd.) was added to 61 parts of a 5% aqueous solution of ethylene-modified polyvinyl alcohol, and 8.4 parts of a 2% aqueous solution of sodium (4-nonylphenoxytrioxyethylene)butylsulfonate, 8 parts of a fluorine-containing releasing agent (ME-313, produced by Daikin Industries, Ltd.) and 0.5 part of flour starch were added thereto, followed by uniformly stirred, to prepare a polyvinyl alcohol liquid.

Separately, 12.5 parts of 20% aqueous solution of Kaogloss (produced by Shiraishi Industry Co., Ltd.), 1.25 parts of 10% polyvinyl alcohol (PVA105, produced by Kuraray Co., Ltd.) and 0.39 part of a 2% aqueous solution of sodium dodecylbenzenesulfonate were mixed and dispersed with a dyno mill to prepare a pigment liquid.

4.4 parts of the pigment liquid was added to 80 parts of the polyvinyl alcohol liquid to obtain a coating solution for a protective layer.

Formation of Recording Layer

Seven layers, i.e., a recording layer A, an intermediate layer, a recording layer B, an intermediate layer, a recording layer C, a light transmittance adjusting layer and a protective layer, in this order from the lower layer, were simultaneously and continuously formed on the support for photographic paper having the undercoating layer at a coating speed of 60 m/min, and were dried under conditions of 30° C. and 30% RH and conditions of 40° C. and 30% RH to obtain a multi-color heat-sensitive recording material. The solid coated amounts were 6.0 g/m$^2$ for the recording layer A, 3.0 g/m$^2$ for the intermediate layer, 6.0 g/m$^2$ for the recording layer B, 3.0 g/m$^2$ for the intermediate layer, 5.0 g/m$^2$ for the recording layer C, 3.0 g/m$^2$ for the light transmittance adjusting layer and 1.5 g/m$^2$ for the protective layer.

Example 2

A recording material was produced in the same manner as in Example 1 except that 8 parts of water and 3.0 parts of the 4% 2-ethylenesulfonyl-N-[2-(2-ethylenesulfonyl-acetylamino)-ethyl]acetamide aqueous solution in the preparation of the coating solution for an undercoating layer in Example 1 were changed to 10 parts of water and 0.9 part of the 4% 2-ethylenesulfonyl-N-[2-(2-ethylenesulfonyl-acetylamino)-ethyl]acetamide aqueous solution.

Example 3

A recording material was produced in the same manner as in Example 1 except that 8 parts of water and 19.0 parts of the 8% mica dispersion in the preparation of the coating slution for an undercoating layer in Example 1 were changed to 22 parts of water and 5.4 parts of the 8% mica dispersion. The coating solution for an undercoating layer in this example had a concentration of 6.4%. In this example, the mass ratio (x/y) of the amount (x) of the acetoacetyl-modified polyvinyl alcohol and the amount (y) of the water swelling synthetic mica was 30.

Example 4

A recording material was produced in the same manner as in Example 1 except that 76 parts of methanol and 19.0 parts of the 8% mica dispersion in the preparation of the coating solution for an undercoating layer in Example 1 were changed to 14 parts of methanol and 80.3 parts of the 8% mica dispersion. The coating solution for an undercoating layer in this example had a concentration of 9.3%. In this example, the mass ratio (x/y) of the amount (x) of the acetoacetyl-modified polyvinyl alcohol and the amount (y) of the water swelling synthetic mica was 2.0.

Example 5

A recording material was produced in the same manner as in Example 1 except that 76 parts of methanol and 19.0 parts of the 8% mica dispersion in the preparation of the coating solution for an undercoating layer in Example 1 were changed to 91 parts of methanol and 4.0 parts of the 8% mica dispersion. The coating solution for an undercoating layer in this example had a concentration of 6.4%. In this example, the mass ratio (x/y) of the amount (x) of the acetoacetyl-modified polyvinyl alcohol and the amount (y) of the water swelling synthetic mica was 40.

Example 6

A recording material was produced in the same manner as in Example 1 except that 76 parts of methanol and 19.0 parts of the 8% mica dispersion in the preparation of the coating solution for an undercoating layer in Example 1 were changed to 5 parts of methanol and 90.6 parts of the 8% mica dispersion. The coating solution for an undercoating layer in this example had a concentration of 9.7%. In this example, the mass ratio (x/y) of the amount (x) of the acetoacetyl-modified polyvinyl alcohol and the amount (y) of the water swelling synthetic mica was 1.8.

Example 7

A recording material was produced in the same manner as in Example 1 except that 3.0 parts of the 4% 2-ethylenesulfonyl-N-[2-(2-ethylenesulfonyl-acetylamino)-ethyl]acetamide aqueous solution in the preparation of the coating solution for an undercoating layer in Example 1 was changed to 3.0 parts of 4% 1,1-bisvinylsulfoneethane.

Example 8

A recording material was produced in the same manner as in Example 1 except that 3.0 parts of the 4% 2-ethylenesulfonyl-N-[2-(2-ethylenesulfonyl-acetylamino)-ethyl]acetamide aqueous solution in the preparation of the coating solution for an undercoating layer in Example 1 was changed to 3.0 parts of 4% ethylene-bis-acrylamide.

Comparative Example 1

A recording material was produced in the same manner as in Example 1 except that 100 parts of the 12.85% acetoacetyl-modified polyvinyl alcohol solution in the preparation of the coating solution for an undercoating layer in Example 1 was changed to 100 parts of a 12.85% poval (saponification degree: 88%, polymerization degree: about 1,000, trade name: PVA-210, produced by Kuraray Co., Ltd.).

Comparative Example 2

A recording material was produced in the same manner as in Example 1 except that the 4% 2-ethylenesulfonyl-N-[2-(2-ethylenesulfonyl-acetylamino)ethyl]acetamide aqueous solution in the preparation of the coating solution for an undercoating layer in Example 1 was not used.

Comparative Example 3

A recording material was produced in the same manner as in Example 1 except that 3.0 parts of the 4% 2-ethylenesulfonyl-N-[2-(2-ethylenesulfonyl-acetylamino)-ethyl]acetamide aqueous solution in the preparation of the coating solution for an undercoating layer in Example 1 was changed to 3.0 parts of 4% 2,3-dihydroxy-5-methyl-1,4-dioxane.

Evaluation

The resulting multi-color heat-sensitive recording materials were evaluated in the following manner.

(1) Evaluation of Blister

A black solid image was recorded on a reference sample (Thermo-Autochrome Paper RA5-G100, produced by Fuji Photo Film Co., Ltd.) by using a digital color printer (trade name; FUJIX NC370D, produced by Fuji Photo Film Co., Ltd.) under various recording conditions including those shown in Table 1 as a maximum output power. The respective pieces of the reference sample were cut, and formation state of blister was evaluated by observing the cross sections of the reference sample by the naked eye.

TABLE 1

| | Line cycle | Applied voltage | Electrification time |
|---|---|---|---|
| Yellow | 7.6 ms/line | 19 V | 4,167 μs |
| Magenta | 7.6 ms/line | 21 V | 5,320 μs |
| Cyan | 13.3 ms/line | 22 V | 8,031 μs |

The surface condition level of the reference sample piece recorded with the maximum output power which caused the most frequent formation of blister was designated as 1 point, and the surface condition level of the reference sample piece having no formation of blister was designated as 5 points. The surface condition levels of the reference sample pieces recorded with output power between the highest output power of the reference sample pieces having no formation of blister and the maximum output power were sequentially designated as 2 to 4 points. The evaluation of 3 points or higher meant a surface condition levels that caused no problem in practical use.

The recording materials of Examples 1 to 8 and Comparative Examples 1 to 3 having a black solid image recorded by the blister test described above were cut, and the cross sections thereof were observed to evaluate formation state of blister by the naked eye. The samples were compared with the reference sample pieces, and the surface condition level of the reference sample piece exhibiting the closest surface condition level to that of the sample was designated as an evaluation of the sample. The evaluations of the recording materials are shown in Table 2 below.

(2) Evaluation of Water Resistance

An image was printed on the recording materials of Examples 1 to 8 and Comparative Examples 1 to 3, and the recording materials were immersed in water at 20° C. for 24 hours. A sample suffering no release of the films and no shrinkage of the coated films was designated as A (good), a sample suffering only slight shrinkage on edges was designated as B (fair), and a sample suffering release of at least part of the film was designated as poor (C). The evaluations of the recording materials are shown in Table 2.

(3) Coated Surface Property

When the viscosity of the coating solution for an undercoating layer was from 0.1 to 0.3 Pa·s at 40° C., substantially no gravure mark nor coating streak occurred. When it exceeds 0.3 Pa·s, vertical coating streak and gravure mark were liable to occur, and when it was less than 0.1 Pa·s, weak gravure marks and coating failure in the form of rain drops occurred. The gravure coated surface property was evaluated by immersing the sample in blue black ink (Pilot Corp.). A case where no occurrence of gravure mark nor surface property in the form of rain drops was observed was designated as A (good) a case where the occurrence thereof was slightly observed was designated as B (fair), and the case where the occurrence thereof was frequently observed was designated as C (poor).

(4) Evaluation of Viscosity of Coating Solution for Undercoating Layer

The viscosities of the coating solution for an undercoating layer of the recording material of Examples 1 and 2 and Comparative Examples 1 to 3 were measured immediately after the preparation thereof and after 1 day from the preparation by using a viscometer (MODEL RB80, produced by Toki Sangyo Co., Ltd.) to measure the extent of increment of the viscosity. The results of the measurement of viscosity are shown in Table 2.

TABLE 2

| | Evaluation of blister | Evaluation of water resistance | Evaluation of Coated surface property | Viscosity of coating solution for undercoating layer (mPa · s) Immediately after preparation | After 1 day |
|---|---|---|---|---|---|
| Example 1 | 5 | A | A | 110 | 130 |
| Example 2 | 5 | A | A | 105 | 114 |
| Example 3 | 5 | A | A | — | — |
| Example 4 | 5 | A | A | — | — |
| Example 5 | 4.5 | A | A | — | — |
| Example 6 | 5 | B–A | A | — | — |
| Example 7 | 5 | A | A | — | — |
| Example 8 | 5 | A | A | — | — |
| Comparative Example 1 | 3.5 | C | C | 103 | 99 |
| Comparative Example 2 | 5 | C | A | 98 | 104 |
| Comparative Example 3 | 5 | A | B | 152 | 380 |

It was understood from the results shown in Table 2 that the recording materials of Examples 1 to 8 suffered less formation of blister, were excellent in water resistance, caused less viscosity increase with time and were good in coated surface property, but the recording materials of Comparative Examples 1 to 3 could not exhibit good results in all the evaluation at the same time.

What is claimed is:

1. A recording material comprising a support having a recording layer thereon capable of forming a color with the application of heat and/or pressure, the material further comprising at least one layer containing acetoacetyl-modified polyvinyl alcohol and a hardening agent between the support and the recording layer; and wherein the hardening agent is a compound having, in one molecule thereof, two or more vinyl groups adjacent to a substituent having a positive Hammett's substituent constant σp.

2. The recording material of claim 1, wherein the hardening agent is 2-ethylenesulfonyl-N-[2-(2-ethylenesulfonylacetylamino)ethyl]acetamide.

3. The recording material of claim 2, wherein the acetoacetyl-modified polyvinyl alcohol has a polymerization degree of 1,000 or more.

4. The recording material of claim 2, wherein the layer containing the acetoacetyl-modified polyvinyl alcohol and the hardening agent further contains a lamellar inorganic compound.

5. The recording material of claim 4, wherein the lamellar inorganic compound is water swelling synthetic mica, and amass ratio (x/y) of amass (x) of the acetoacetyl-modified polyvinyl alcohol and a mass (y) of the water swelling synthetic mica is in a range of from 2 to 30.

6. The recording material of claim 2, wherein the support is a laminated support comprising a paper substrate having a polyolefin laminated on both surfaces thereof, and the layer containing the acetoacetyl-modified polyvinyl alcohol and the hardening agent is adjacent to the support.

7. The recording material of claim 2, wherein the recording layer comprises a plurality of layers forming yellow, magenta and cyan colors, respectively.

8. The recording material of claim 1, wherein the acetoacetyl-modified polyvinyl alcohol has a polymerization degree of 1,000 or more.

9. The recording material of claim 8, wherein the layer containing the acetoacetyl-modified polyvinyl alcohol and the hardening agent further contains a lamellar inorganic compound.

10. The recording material of claim 9, wherein the lamellar inorganic compound is water swelling synthetic mica, and amass ratio (x/y) of a mass (x) of the acetoacetyl-modified polyvinyl alcohol and amass (y) of the water swelling synthetic mica is in a range of from 2 to 30.

11. The recording material of claim 8, wherein the support is a laminated support comprising a paper substrate having a polyolefin laminated on both surfaces thereof, and the layer containing the acetoacetyl-modified polyvinyl alcohol and the hardening agent is adjacent to the support.

12. The recording material of claim 8, wherein the recording layer comprises a plurality of layers forming yellow, magenta and cyan colors, respectively.

13. The recording material of claim 1, wherein the layer containing the acetoacetyl-modified polyvinyl alcohol and the hardening agent further contains a lamellar inorganic compound.

14. The recording material of claim 13, wherein the lamellar inorganic compound is water swelling synthetic mica, and amass ratio (x/y) of amass (x) of the acetoacetyl-modified polyvinyl alcohol and amass (y) of the water swelling synthetic mica is in a range of from 2 to 30.

15. The recording material of claim 14, wherein the support is a laminated support comprising a paper support having a polyolefin laminated on both surfaces thereof, and the layer containing the acetoacetyl-modified polyvinyl alcohol and the hardening agent is adjacent to the support.

16. The recording material of claim 14, wherein the recording layer comprises a plurality of layers forming yellow, magenta and cyan colors, respectively.

17. The recording material of claim 13, wherein the support is a laminated support comprising a paper substrate having a polyolefin laminated on both surfaces thereof, and the layer containing the acetoacetyl-modified polyvinyl alcohol and the hardening agent is adjacent to the support.

18. The recording material of claim 13, wherein the recording layer comprises a plurality of layers forming yellow, magenta and cyan colors, respectively.

19. The recording material of claim 1, wherein the support is a laminated support comprising a paper substrate having a polyolefin laminated on both surfaces thereof, and the layer containing the acetoacetyl-modified polyvinyl alcohol and the hardening agent is adjacent to the support.

20. The recording material of claim 1, wherein the recording layer comprises a plurality of layers forming yellow, magenta and cyan colors, respectively.

* * * * *